US007106273B1

(12) United States Patent
Brunson et al.

(10) Patent No.: US 7,106,273 B1
(45) Date of Patent: Sep. 12, 2006

(54) ANTENNA MOUNTING APPARATUS

(75) Inventors: James S. Brunson, Dallas, TX (US); Hiep X. Nguyen, Fort Worth, TX (US)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/217,235

(22) Filed: Dec. 21, 1998

(51) Int. Cl.
*H01Q 1/12* (2006.01)

(52) U.S. Cl. ..... 343/890; 343/878; 343/892

(58) Field of Classification Search ..... 343/890, 343/891, 892, 878; 248/230.4
See application file for complete search history.

(56) References Cited

U.S. PATENT DOCUMENTS 3,318,561 A * 5/1967 Finke et al. ..... 343/890
4,194,459 A * 3/1980 Lisowski ..... 114/221 R
5,467,955 A * 11/1995 Beyersmith ..... 343/890
5,787,673 A * 8/1998 Noble ..... 52/726.1
5,926,151 A * 7/1999 Hagiwara et al. ..... 343/892
6,262,691 B1 * 7/2001 Austin et al. ..... 343/890
6,283,425 B1 * 9/2001 Liljevik ..... 248/230.4

* cited by examiner

*Primary Examiner*—Tan Ho

(57) ABSTRACT

There is disclosed an apparatus for mounting antennas on a utility pole. The apparatus comprises a group of brackets that encircle the utility pole and support the antennas. Each bracket comprises at least one support arm capable of attaching to an antenna and a faceplate that presses against the surface of the utility pole. The apparatus also includes tightening or closure means, such as nut and bolt assemblies, that connect the brackets together. When tightened, the tightening means draw the brackets encircling the utility pole closer together, thereby pressing the faceplates of each bracket more firmly against the utility pole. This clamps the apparatus tightly in place at selected points on the utility pole.

20 Claims, 2 Drawing Sheets

ANTENNA MOUNTING APPARATUS

TECHNICAL FIELD OF THE INVENTION

The present invention is directed, in general, to antenna systems and, more specifically, to an apparatus for easily mounting and adjusting an antenna on a pole or similar fixture.

BACKGROUND OF THE INVENTION

In recent years there has been a rapid growth in the use of wireless devices, including one-way and two-way pagers, cellular phones, personal communication services (PCS) systems, and personal computers (PCs) equipped with cellular modems or wireless network cards. To support this growth, wireless service providers have dramatically increased the amount and the density of wireless network infrastructure deployed nationwide.

The large number of subscribers and the many applications for wireless communications have created a heavy subscriber demand for RF bandwidth. To maximize usage of the available bandwidth, a number of multiple access technologies have been implemented to allow more than one subscriber to communicate simultaneously with each base transceiver station (BTS) in a wireless system. These multiple access technologies include time division multiple access (TDMA), frequency division multiple access (FDMA), and code division multiple access (CDMA). These technologies assign each system subscriber to a specific traffic channel that transmits and receives subscriber voice/data signals via a selected time slot, a selected frequency, a selected unique code, or a combination thereof.

To further augment the capacity of their wireless networks and provide coverage to greater numbers of subscribers, wireless service providers increasingly are using a larger number of smaller-sized cell sites to cover the same amount of territory. Since each cell site covers a relatively smaller geographical area, each cell site generally also encompasses a smaller number of subscribers, all other things being equal. This allows greater reuse of frequency bands, time slots and codes in FDMA, TDMA and CDMA wireless networks.

However, the use of a larger number of smaller cell sites also increases the infrastructure equipment required by a wireless network. For example, doubling the number of cells sites covering a particular territory generally doubles the number of base transceiver stations, the number of antennas, the number of antenna poles, and the like.

To offset increased infrastructure equipment requirements, wireless service providers seek to minimize the equipment cost, installation costs, and maintenance costs. The use of standard commodity equipment is encouraged. It also is particularly helpful to use infrastructure equipment that is multi-purpose, adaptable, quickly installed, and easy to disassemble and service.

Much of the antenna equipment that has been installed, however, is inflexible, difficult to maintain, and/or custom-made to fit specific systems. For instance, many base station antennas are mounted on fixed platforms that are rigidly or permanently attached to utility poles. This makes moving, replacing, and/or adjusting the antennas difficult and more expensive.

There is therefore a need in the art for improved antenna mounting equipment that is more adaptable and easier to maintain and adjust. In particular, there is a need for antenna mounting equipment that is simple to attach to, or detach from, a utility pole. More particularly, there is a need for antenna mounting equipment that uses standard parts, but which can be adapted for use with utility poles of varying diameters and cross-sectional shapes.

SUMMARY OF THE INVENTION

To address the above-discussed deficiencies of the prior art, it is a primary object of the present invention to provide an apparatus for mounting a plurality of antennas on a utility pole. The apparatus comprises 1) a plurality of brackets capable of encircling the utility pole and supporting the plurality of antennas, each of the plurality of brackets comprising a) at least one support arm capable of attaching to a first selected one of the plurality of antennas; and b) a faceplate capable of engaging a surface of the utility pole; and 2) a plurality of tightening means, each of the tightening means connecting a first selected one of the plurality of brackets and a second selected one of the plurality of brackets, wherein the plurality of tightening means are capable of drawing the plurality of brackets encircling the utility pole closer together, such that the faceplate of the each of the plurality of brackets is pressed more firmly against the surface of the utility pole.

Accordingly in one embodiment of the apparatus, the plurality of brackets comprise three brackets.

In an alternate embodiment of the apparatus, the plurality of brackets comprise four brackets.

In another embodiment of the apparatus, at least a portion of a surface of the faceplate capable of engaging the surface of the utility pole is covered by a layer of rubber.

In still another embodiment of the apparatus, at least a portion of a surface of the faceplate capable of engaging the surface of the utility pole is covered by ridges.

In yet another embodiment of the apparatus, at least a portion of a surface of the faceplate capable of engaging the surface of the utility pole is covered by sharp points.

In a further embodiment of the apparatus, at least a portion of a surface of the faceplate capable of engaging the surface of the utility pole has a rough texture capable of increasing friction with the surface of the utility pole.

In a still further embodiment of the apparatus, each of the plurality of brackets comprises a first support arm and a second arm, wherein the first support arm is capable of attaching to one side of the first selected antenna and the second support arm is capable of attaching to an opposing side of the first selected antenna.

In a yet further embodiment of the apparatus, the plurality of tightening means comprise a plurality of bolts.

In another embodiment of the apparatus, the first selected antenna is adjustably attached to the at least one support arm, such that the first selected antenna may be tilted with respect to the horizon in a plurality of positions.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

Before undertaking the DETAILED DESCRIPTION, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION

Figure 1:
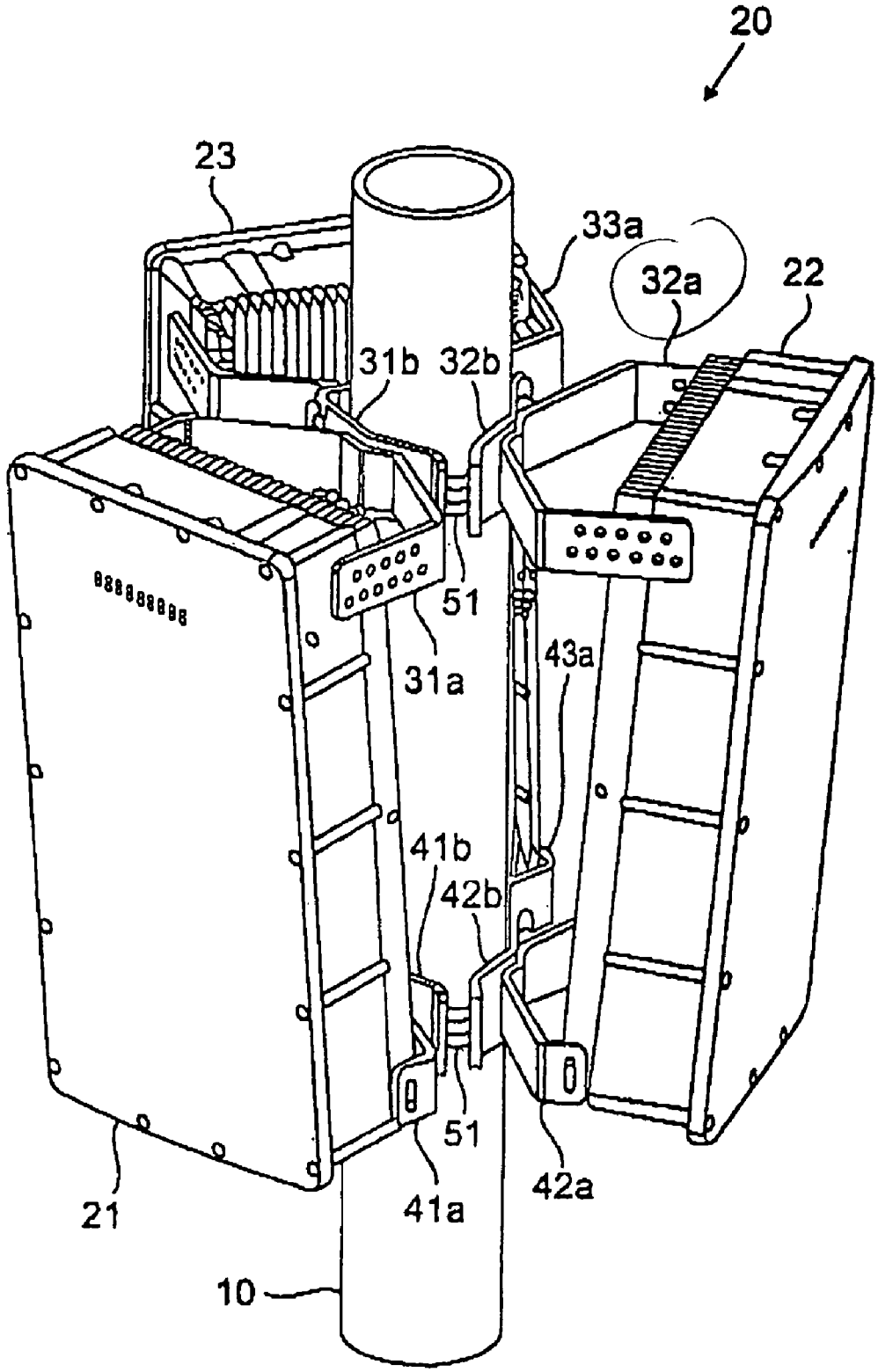
FIG. 1 illustrates a perspective view of an exemplary multi-sector antenna system according to one embodiment of the present invention.
Figure 2:
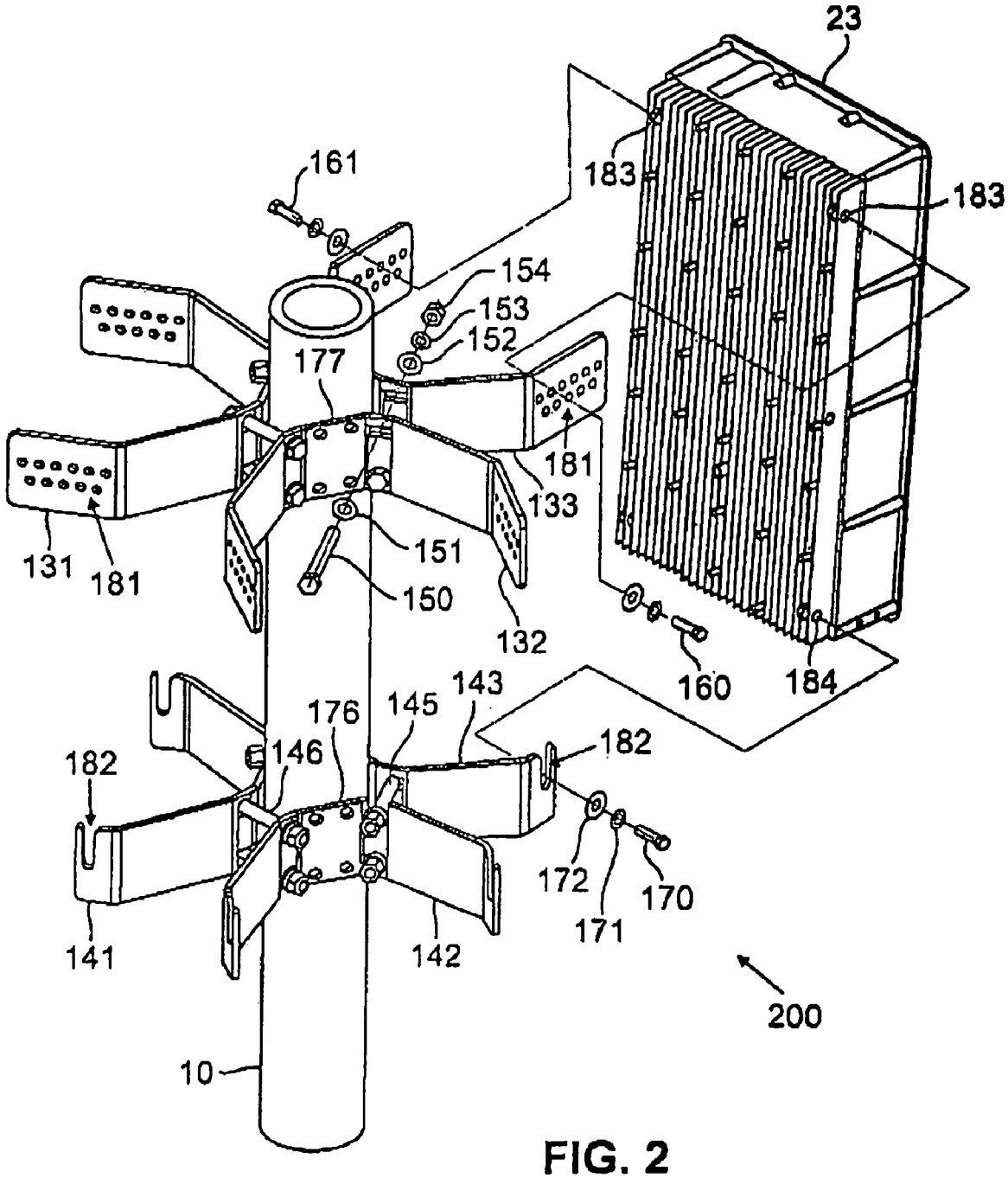
FIG. 2 illustrates an exploded perspective view of an exemplary multi-sector antenna system according to another embodiment of the present invention.

FIGS. 1 and 2, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged multi-sector antenna.

FIG. 1 illustrates a perspective view of multi-sector antenna system 20 according to one embodiment of the present invention. Multi-sector antenna system 20 comprises three individual sector antennas, namely antenna 21, antenna 22 and antenna 23, mounted on utility pole 10. Multi-sector antenna system 20 is associated with a single base transceiver station (BTS) that serves a single cell site in a wireless network. Each of antennas 21–23 transmits and receives signals in a specified 120° arc around the cell site.

Antenna 21 is attached to utility pole 10 by means of upper bracket 31 and lower bracket 41. Upper bracket 31 comprises two parts: attachment bracket 31*a* and faceplate 31*b*. Lower bracket 41 also comprises two parts: attachment bracket 41*a* and faceplate 41*b*. Attachment bracket 31*a* comprises two support arms that extend outward from utility pole 10 to support antenna 21. Attachment bracket 31*a* is removably attached to an upper portion of antenna 21. Attachment bracket 41*a* also comprises two support arms that extend outward from utility pole 10 to support antenna 21. Attachment bracket 41*a* is removably attached to a lower portion of antenna 21. Attachment brackets 31*a* and 41*a* are fixedly attached to faceplates 31*b* and 41*b*, respectively. Faceplates 31*b* and 41*b* connect to other faceplates associated with antennas 22 and 23 and are tightened into place to form a strong friction grip against utility pole 10. To increase friction with utility pole 10, the inner surfaces of faceplates 31*b* and 41*b* may be rubber coated, or covered by rough ridges or points, similar to the surface of a file or a rasp.

In a similar manner, antenna 22 is attached to utility pole 10 by means of upper bracket 32 and lower bracket 42. Upper bracket 32 comprises attachment bracket 32*a* and faceplate 32*b*. Lower bracket 42 comprises attachment bracket 42*a* and faceplate 42*b*. Attachment bracket 32*a* comprises two support arms that extend outward from utility pole 10 to support antenna 22. Attachment bracket 32*a* is removably attached to an upper portion of antenna 22 and attachment bracket 42*a* is removably attached to a lower portion of antenna 22. Faceplates 32*b* and 42*b* connect to other faceplates (e.g., faceplates 31*b*, 41*b*) associated with antennas 21 and 23 and are tightened into place to form a strong friction grip against utility pole 10. The inner surfaces of faceplates 32*b* and 42*b* also may be rubber coated, or covered by sharp ridges and/or points to give it a rough texture.

Finally, antenna 23 is attached to utility pole 10 by means of upper bracket 33 and lower bracket 43 (not visible). Upper bracket 33 comprises attachment bracket 33*a* and faceplate 33*b* (not visible). Lower bracket 43 comprises attachment bracket 43*a* and faceplate 43*b* (not visible). Attachment bracket 33*a* is removably attached to an upper portion of antenna 23 and attachment bracket 43*a* is removably attached to a lower portion of antenna 23. Faceplates 33*b* and 43*b* connect to faceplates 31*b*, 32*b*, 41*b*, and 42*b* on antennas 21 and 22 and are tightened against utility pole 10. As before, the inner surfaces of faceplates 33*b* and 43*b* also may be rubber coated, or covered by sharp ridges and/or points to increase friction with utility pole 10.

The upper portion of antenna 21 is attached to attachment bracket 31*a* by means of a bolt or dowel that is inserted through one of a plurality of holes in attachment bracket 31*a* and into a corresponding upper side hole in antenna 21. Antenna 21 may be tilted upward or downward with respect to the horizon by inserting the bolt or dowel through selected holes in attachment bracket 31*a*. The lower portion of antenna 21 is attached to attachment bracket 41*a* by means of a bolt or dowel that is inserted through an elongated slot (or hole) in attachment bracket 41*a* and into a corresponding lower side hole in antenna 21. The bolt in the slot in attachment bracket 41*a* can slide up and down to accommodate different positions as antenna 21 is tilted up or down by selecting different holes in attachment bracket 31*a*.

Antennas 22 and 23 may be positioned at different angles of downtilt in attachment brackets 32*a*, 33*a*, 42*a*, and 43*a* in a manner similar to that described above with respect to antenna 21. To avoid redundancy, further explanation of the tilting operations of antennas 22 and 23 is omitted.

Upper brackets 31, 32, and 33 encircle utility pole 10 and are joined together by means of threaded bolts 51 in the flanges of faceplates 31*b*, 32*b*, and 33*b*. Similarly, lower brackets 41, 42, and 43 encircle utility pole 10 and are joined together by means of threaded bolts 51 in the flanges of faceplates 41*b*, 42*b*, and 43*b*. Antennas 21–23 may be mounted on utility poles 10 of varying diameters by tightening or loosening bolts 51, thereby increasing or decreasing the gaps separating faceplates 31*b*, 32*b*, and 33*b* and drawing the inner surfaces of faceplates 41*b*, 42*b*, and 43*b* closer together. Tightening the bolts effectively reduces the circumference of any cylinder (i.e., pole) that may be inserted within the inner surfaces of the faceplates 41*b*, 42*b*, and 43*b*.

Although three upper brackets 31–33 are used to attach the tops of antennas 21–23 to utility pole 10 and three lower brackets 41–43 are used to attach the bottoms of antennas 21–23 to utility pole 10, different numbers of brackets may be used. For example, utility pole 10 may support four antenna units if the cell site in which utility pole 10 is located is divided into four (4) 90° sectors. In such a case, each antenna unit would be separated by four brackets at the top and four brackets at the bottom. Furthermore, there is no requirement that utility pole 10 have a circular cross-sectional area. For example, if utility pole 10 was hexagonal in its cross-sectional area, upper brackets 31–33 and lower brackets 41–43 may still be used to attach antennas 21–23. If utility pole 10 is square in its cross-sectional area, a system of four upper brackets and four lower brackets may be used to attach four antenna units.

FIG. 2 illustrates an exploded perspective view of exemplary multi-sector antenna system 200 according to another embodiment of the present invention. For the purposes of brevity and clarity in explaining FIG. 2, only antenna 23 is shown and described. However, antennas 21 and 22 are mounted on utility pole 10 in a manner similar to antenna 23.

In FIG. 2, the upper brackets and lower brackets used to attach antennas 21–23 are comprised of a single part, rather than two parts. The tops of antennas 21–23 are mounted on utility pole 10 by means of attachment brackets 131–133, each of which has a flat faceplate portion that makes contact with utility pole 10. For example, faceplate segment 177 of attachment bracket 132 makes contact with utility pole 10 when brackets 131–133 are tightened in place. The inner surface of faceplate segment 177 may be covered by a layer of rubber or by rough ridges or points in order to increase friction with utility pole 10.

Similarly, the bottoms of antennas 21–23 are mounted on utility pole 10 by means of attachment brackets 141–143, each of which has a flat faceplate portion that makes contact with utility pole 10. For example, faceplate segment 176 of attachment bracket 142 makes contact with utility pole 10 when brackets 141–143 are tightened in place. The inner surface of faceplate segment 176 may also be covered by rubber or rough ridges/points in order to increase friction with utility pole 10.

Bolt assemblies, including bolts 145, 146 and 150, are used to tighten together attachment brackets 131–133 and attachment brackets 141–143. An exploded view is shown of a bolt assembly comprising bolt 150, washers 151–153, and nut 154. Bolt 150 is inserted through slots in attachment brackets 131 and 133. Depending on how large the slots are, bolt 150 may slide outward by varying amounts with respect to utility pole 10 in order to accommodate different pole diameters.

Antenna 23 is mounted on upper attachment bracket 133 and lower attachment bracket 143 by means of bolts 160, 161 and 170 that are inserted through holes 181 in the support arms of upper attachment bracket 133 or through slots 182 in the support arms of lower attachment bracket 143 and then into corresponding sideholes 183 and 184 in antenna 23. The bolt are secured in place with washers 171 and 172.

Antenna 23 may be tilted upward or downward with respect to the horizon by inserting bolts 160 and/or 161 through different ones of holes 181 in upper attachment bracket 133 and then into sideholes 183 in antenna 23. The lower portion of antenna 23 is rotatably mounted on lower attachment bracket 143 by means of bolt 170, which is inserted through slot 182 in lower attachment bracket 143 and into corresponding sidehole 184 in antenna 23. Bolt 170 can slide vertically and rotate in slot 182 to accommodate different positions as antenna 23 is tilted up or down by selecting different holes 181 in attachment bracket 133.

The attachment brackets of the present invention provide a superior means for mounting antennas on a utility pole over the prior art. The attachment brackets accommodate poles of different diameters and may be attached using simple hand tools, such as wrenches. A technician may easily adjust the height at which antennas 21–23 are mounted on utility pole 10 by loosening bolts 145/146/150 in the upper and lower attachment brackets and then sliding the entire assembly up or down to the correct position. A technician also may easily adjust the tilt or antennas 21–23 by removing bolts 160 and 161 in the upper attachment bracket, tilting the antenna(s) to the correct angle, and then reinserting bolts 160 and 166. The present invention also allows the antennas to be tilted independently.

Advantageously, the present invention obviates the need to modify or adapt the utility pole in any way in order to mount antennas thereon. The present invention can be quickly attached to different-sized utility poles that are part of the existing wireless infrastructure or to new utility poles without the need to drill, weld or otherwise alter the poles.

In alternate embodiments of the present invention, bolts 51, 145, 146, and 150 may be replaced by other types of tightening means (or closure means) that secure the attachment brackets to the utility pole. For example, the attachment brackets may be mounted on the utility pole by means of a belt that is threaded through holes or slots in the attachment brackets and then is tightened, cinched or latched in place, similar to a radiator hose clamp.

Although the present invention has been described in detail, those skilled in the art should understand that they can make various changes, substitutions and alterations herein without departing from the spirit and scope of the invention in its broadest form.

What is claimed is:

1. An apparatus for mounting a plurality of antennas on a utility pole, said apparatus for mounting comprising:

a plurality of brackets capable of encircling said utility pole and supporting said plurality of antennas, each of said plurality of brackets comprising:

at least one support arm capable of attaching to a first selected one of said plurality of antennas; and a faceplate capable of engaging a surface of said utility pole; and a plurality of tightening means, each of said tightening means connecting a first selected one of said plurality of brackets and a second selected one of said plurality of brackets, wherein said plurality of tightening means are capable of drawing said plurality of brackets encircling said utility pole closer together, such that said faceplate of said each of said plurality of brackets is pressed more firmly against said surface of said utility pole.

2. The apparatus for mounting set forth in claim 1 wherein said plurality of brackets comprise three brackets.

3. The apparatus for mounting set forth in claim 1 wherein said plurality of brackets comprise four brackets.

4. The apparatus for mounting set forth in claim 1 wherein at least a portion of a surface of said faceplate capable of engaging said surface of said utility pole is covered by a layer of rubber.

5. The apparatus for mounting set forth in claim 1 wherein at least a portion of a surface of said faceplate capable of engaging said surface of said utility pole is covered by ridges.

6. The apparatus for mounting set forth in claim 1 wherein at least a portion of a surface of said faceplate capable of engaging said surface of said utility pole is covered by sharp points.

7. The apparatus for mounting set forth in claim 1 wherein at least a portion of a surface of said faceplate capable of engaging said surface of said utility pole has a rough texture capable of increasing friction with said surface of said utility pole.

8. The apparatus for mounting set forth in claim 1 wherein said each of said plurality of brackets comprises a first support arm and a second support arm, wherein said first support arm is capable of attaching to one side of said first selected antenna and said second support arm is capable of attaching to an opposing side of said first selected antenna.

9. The apparatus for mounting set forth in claim 1 wherein said plurality of tightening means comprise a plurality of bolts.

10. The apparatus for mounting set forth in claim 1 wherein said first selected antenna is adjustably attached to said at least one support arm, such that said first selected antenna is capable of being tilted with respect to the horizon in a plurality of positions.

11. An antenna mounting system for mounting a plurality of antennas on a utility poles said antenna mounting system comprising:

at least three upper brackets capable of encircling said utility pole and supporting said plurality of antennas, at least one of said at least three upper brackets comprising at least one upper support arm capable of attaching to an upper portion of a first selected one of said plurality of antennas and a first faceplate capable of engaging a surface of said utility pole; and at least three lower brackets capable of encircling said utility pole and supporting said plurality of antennas, at least one of said three lower brackets comprising at least one lower support arm capable of attaching to a lower portion of a second selected one of said plurality of antennas and a second faceplate capable of engaging said surface of said utility pole; and a plurality of tightening means, a first tightening means connecting a first of said at least three upper brackets and a second of said at least three upper brackets and a second tightening means connecting a first of said at least three lower brackets and a second of said at least three lower brackets, wherein said first and second tightening means are capable of drawing said at least three upper brackets and said at least three lower bracket, respectively, closer together, such that said faceplate of said each of said at least three upper brackets and said faceplate of said each of said at least three lower brackets are pressed more firmly against said surface of said utility pole.

12. The antenna mounting system set forth in claim 11 wherein said at least three upper brackets comprise four brackets.

13. The antenna mounting system set forth in claim 11 wherein said at least three lower brackets comprise tour brackets.

14. The antenna mounting system set forth in claim 11 wherein at least a portion of a surface of said first faceplate and at least a portion of a surface of said second faceplate are covered by a layer of rubber.

15. The antenna mounting system set forth in claim 11 wherein at least a portion of a surface of said first faceplate and at least a portion of a surface of said second faceplate are covered by ridges.

16. The antenna mounting system set forth in claim 11 wherein at least a portion of a surface of said first faceplate and at least a portion of a surface of said second faceplate are covered by sharp points.

17. The antenna mounting system set forth in claim 11 wherein at least a portion of a surface of said first faceplate and at least a portion of a surface of said second faceplate have rough textures capable of increasing friction with said surface of said utility pole.

18. The antenna mounting system set forth in claim 11 wherein each of said at least three upper brackets comprises a first upper support arm and a second upper support arm, wherein said first upper support arm is capable of attaching to one side of said upper portion of said first selected antenna and said second upper support arm is capable of attaching to an opposing side of said upper portion of said first selected antenna.

19. The antenna mounting system set forth in claim 11 wherein each of said at least three lower brackets comprises a first lower support arm and a second lower support arm, wherein said first lower support arm is capable of attaching to one side of said lower portion of said second selected antenna and said second lower support arm is capable of attaching to an opposing side of said lower portion of said second selected antenna.

20. The antenna mounting system set forth in claim 11 wherein said first and second selected antennas are adjustably attached to said at least one upper support arm and said at least one lower support arm, respectively, such that said first and second selected antennas are capable of being tilted with respect to the horizon in a plurality of positions.

* * * * *